US007248242B2

(12) United States Patent
Chen et al.

(10) Patent No.: US 7,248,242 B2
(45) Date of Patent: Jul. 24, 2007

(54) DRIVING CIRCUIT OF A LIQUID CRYSTAL DISPLAY AND DRIVING METHOD THEREOF

(75) Inventors: Cheng-Jung Chen, Miao-Li Hsien (TW); Yuhren Shen, Tai-Nan (TW); Liang-Chen Chien, Chia-Yi Hsien (TW)

(73) Assignee: Vastview Technology Inc., Hsin-Chu (TW)

( * ) Notice: Subject to any disclaimer, the term of this patent is extended or adjusted under 35 U.S.C. 154(b) by 456 days.

(21) Appl. No.: 10/707,362

(22) Filed: Dec. 9, 2003

(65) Prior Publication Data

US 2005/0073630 A1 Apr. 7, 2005

(30) Foreign Application Priority Data

Oct. 1, 2003 (TW) ..... 92127226 A

(51) Int. Cl.
*G09G 3/36* (2006.01)
*G09G 5/10* (2006.01)

(52) U.S. Cl. ..... 345/89; 345/101; 345/690

(58) Field of Classification Search ..... 345/101, 345/690–697

See application file for complete search history.

(56) References Cited

U.S. PATENT DOCUMENTS 6,771,242 B2 8/2004 Ham
2001/0038372 A1 11/2001 Lee
2002/0196218 A1 12/2002 Ham
2002/0196221 A1 12/2002 Morita
2003/0095089 A1 5/2003 Ham
2003/0098839 A1* 5/2003 Lee ..... 345/89
2003/0107546 A1* 6/2003 Ham ..... 345/101

FOREIGN PATENT DOCUMENTS

| | | |
|---|---|---|
| CN | 1407530 A | 4/2003 |
| EP | 0513551 | 11/1992 |
| JP | 04-318516 | 11/1992 |
| JP | 2001-265298 | 9/2001 |
| JP | 2003-84740 | 3/2003 |
| WO | WO-03-041043 | 5/2003 |

* cited by examiner

*Primary Examiner*—Richard Hjerpe
*Assistant Examiner*—M. Fatahiyar
(74) *Attorney, Agent, or Firm*—Winston Hsu

(57) ABSTRACT

The present invention relates to a driving circuit of a liquid crystal display and a driving method thereof. The method includes receiving a M-bit image data from an image data input terminal and extracting N most significant bits (MSB) of the M-bit image data to form a N-bit image data. The N-bit image data is delayed by one frame period to form a N-bit delayed image data. The N-bit delayed image data is compared with P MSB of a current M-bit image data to determine whether to generate a first data voltage according to a first image value selected from a reference table, or to generate a second data voltage according to the current M-bit image data.

10 Claims, 10 Drawing Sheets

DRIVING CIRCUIT OF A LIQUID CRYSTAL DISPLAY AND DRIVING METHOD THEREOF

BACKGROUND OF INVENTION

1. Field of the Invention

The invention relates to a driving circuit of a liquid crystal display and a driving method thereof, and more particularly, to a driving circuit and a driving method with a lookup table (LUT).

2. Description of the Prior Art

A liquid crystal display (LCD) has advantages of lightweight, low power consumption, and low divergence, and is applied to various portable equipment, such as notebook computers and personal digital assistants (PDA). In addition, LCD monitors and LCD televisions are gaining in popularity as a substitute for traditional cathode ray tube (CRT) monitors and televisions. However, an LCD still has some disadvantages. Because of the limitations of physical characteristics, the liquid crystal molecules should be twisted and rearranged when changing input data, and the images will be delayed. For satisfying the rapid switching requirements of multimedia equipment, improving the response speed of liquid crystal is desired.

Please refer to FIG. 1, which is a timing diagram of the pixel voltage and the transmission rate V1 according to a prior art LCD. In FIG. 1, the pixel voltage is shown with the straight lines, and the transmission rate V1 is shown with a dotted line. In FIG. 1, frame N means a frame period, and frame N+1, N+2 . . . mean the following frame periods. When the pixel voltage is switched from a data voltage C1 to a data voltage C2, due to the physical characteristics of liquid crystal molecules, the liquid crystal molecules cannot be twisted to a predetermined angle within a frame period and fail to perform a predetermined transmission rate. As the curve of the transmission rate V1 shows, the transmission rate V1 cannot reach a predetermined transmission rate until the frame period of frame N+2. The delayed switch will cause blurring on the LCD.

An over-driving method is utilized to improve the delayed switch. Please refer to FIG. 2, which is a timing diagram of the pixel voltage and the transmission rate V2 according to a prior art LCD using an over-driving method. When the pixel voltage is switched from the data voltage C1 to the data voltage C2, an over-driving data voltage C3 is added to accelerate the response speed of the liquid crystal molecules. Since a higher data voltage can obtain a faster response speed of the liquid crystal molecules, the data voltage C3 higher than the data voltage C2 can improve the delayed switch to reach the predetermined transmission rate in a frame period. As FIG. 2 shows, the curve of the transmission rate V2 can reach the predetermined transmission rate in frame N.

The U.S. published application Ser. No. 2002/0050965 discloses an over-driving method using a brief table to store the over-driving image data. The brief table only includes part of the over-driving image data for driving the pixels switched from one gray level to another. When the driving circuit receives the image data from the input terminal, a processor is used to perform an interpolation operation to expand the brief table. Hence, an extra algorithm is needed in the conventional over-driving method and the algorithm will slow down the response speed.

SUMMARY OF INVENTION

It is therefore a primary objective of the claimed invention to provide a driving circuit of a liquid crystal display and a driving method thereof to solve the above-mentioned problem.

According to the claimed invention, a driving circuit of a liquid crystal display and a driving method thereof are disclosed. The liquid crystal display includes a liquid crystal panel. The liquid crystal panel has a plurality of scan lines, a plurality of data lines, and a plurality of pixels. Each pixel is connected to a corresponding scan line and a corresponding data line, and each pixel has a switching device connected to the corresponding scan line and the corresponding data line. The driving circuit includes a scan line driving circuit, an image data input terminal, a bit processor, an image memory, a comparison circuit, a lookup table (LUT), a multiplexer, and a data line driving circuit.

The claimed driving method includes continuously providing scan voltages to the scan lines and the bit processor receiving an M-bit image data from an image data input terminal. The N most significant bits (MSB) of the M-bit image data is extracted to form an N-bit image data, with N being smaller than M. The N-bit image data is delayed by a frame period to form an N-bit delayed image data. P MSB of a current M-bit image data are compared with the N-bit delayed image data to determine a result value. If the result value equals a first result value, a first image value is selected from a reference table in accordance with the P MSB and the N-bit delayed image data and a first data voltage is formed according to the first image value, the first data voltage being provided to the corresponding data line. If the result value equals a second result value, a second data voltage is formed in accordance with the current M-bit image data and the second data voltage is provided to the corresponding data line.

In addition, if the result value equals a second result value, the driving method can also select a second image value from a reference table in accordance with the P MSB and the N-bit delayed image data and form a second data voltage in accordance with (M-Q)MSB of the second image value and Q least significant bits (LSB) of the current M-bit image data, and then provide the second data voltage to the corresponding data line.

The claimed invention extracts MSB of the image data to perform the over-driving method without increasing memory. The image process and transmission can be accelerated without increasing hardware cost.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
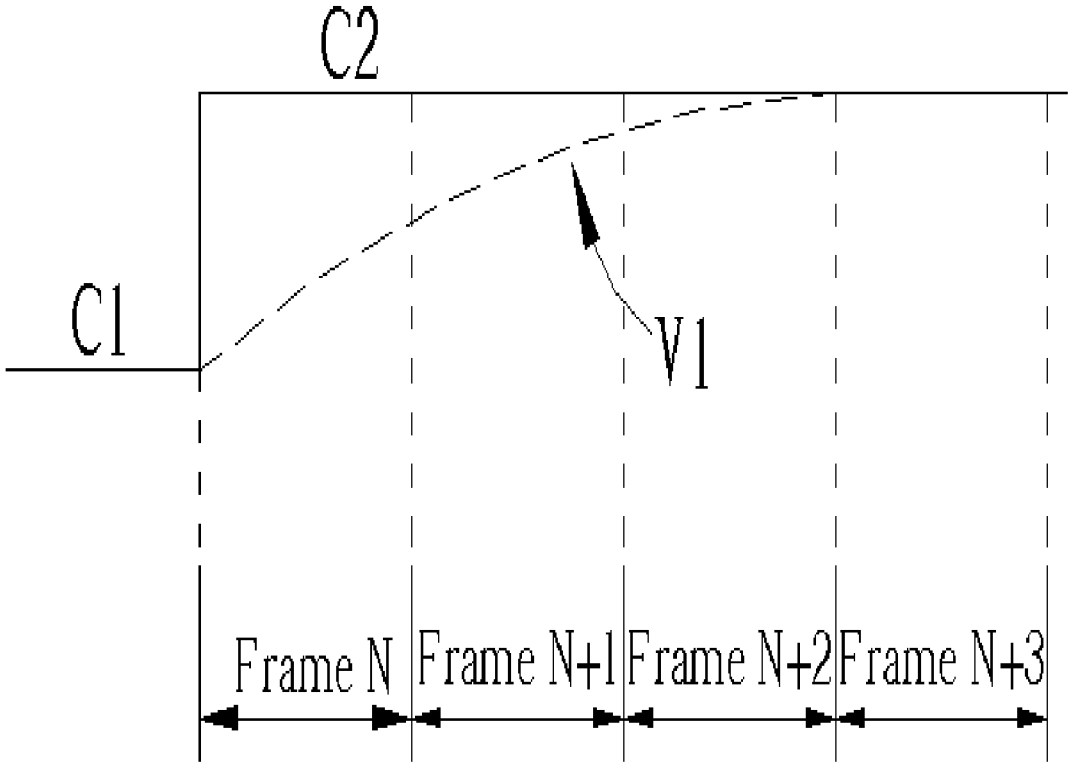
Fig. 1 Prior art
FIG. 1 is a timing diagram of pixel voltage and transmission rate according to prior art.
Figure 2:
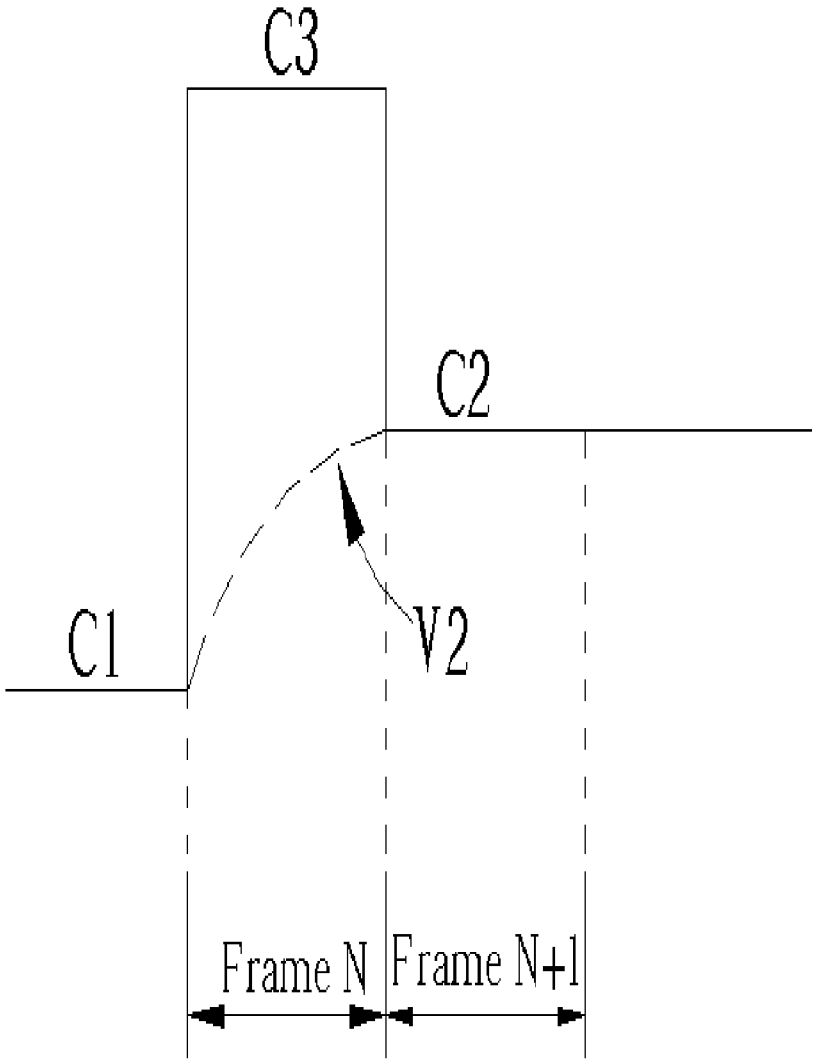
Fig. 2 Prior art
FIG. 2 is another timing diagram of pixel voltage and transmission rate according to prior art using an over-driving method.
Figure 3:
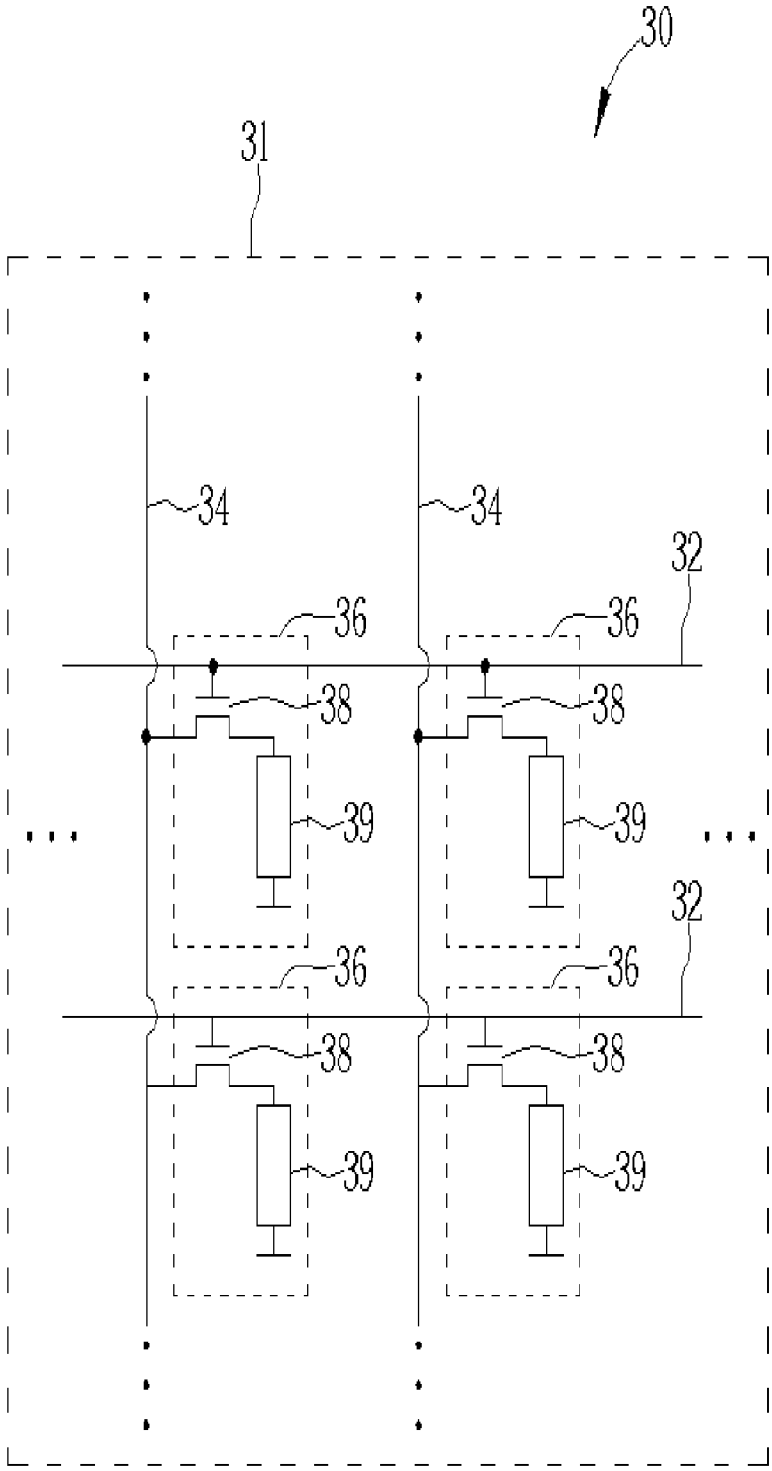
Fig. 3 Prior art
FIG. 3 is a diagram of liquid crystal display.

Please refer to FIG. 3, which is a diagram of a general LCD 30. The LCD 30 comprises a liquid crystal panel 31, and the liquid crystal panel 31 comprises a plurality of scan lines 32, a plurality of data lines 34, and a plurality of pixels 36. Each pixel 36 is connected to a corresponding scan line 32 and a corresponding data line 34, and each pixel 36 has a switching device 38 and a pixel electrode 39. The switching device 38 is connected to the corresponding scan line 32 and the corresponding data line 34.

The driving method of the LCD 30 provides scan voltages to the scan lines 32 to open the switching devices 38, and data voltages are provided to the data lines 34 and transferred to the pixel electrodes 30 through the switching devices 38. When scan voltages are provided to the scan lines 32 to open the switching devices 38, data voltages on the data lines 34 will charge the pixel electrodes 39 through the switch devices 38, and twist the liquid crystal molecules. When scan voltages on the scan lines 32 are removed to close the switching devices 38, the electrical connections between the data lines 34 and the pixel 36 will be cut and the pixel electrodes 39 will remain charged. The scan lines 32 control the switching devices 38 to repeatedly open and close, and thus the pixel electrodes 39 can be repeatedly charged. Different data voltages will cause different twisting angles and show different transmission rates. Hence, the LCD 30 displays different images.

Figure 4:
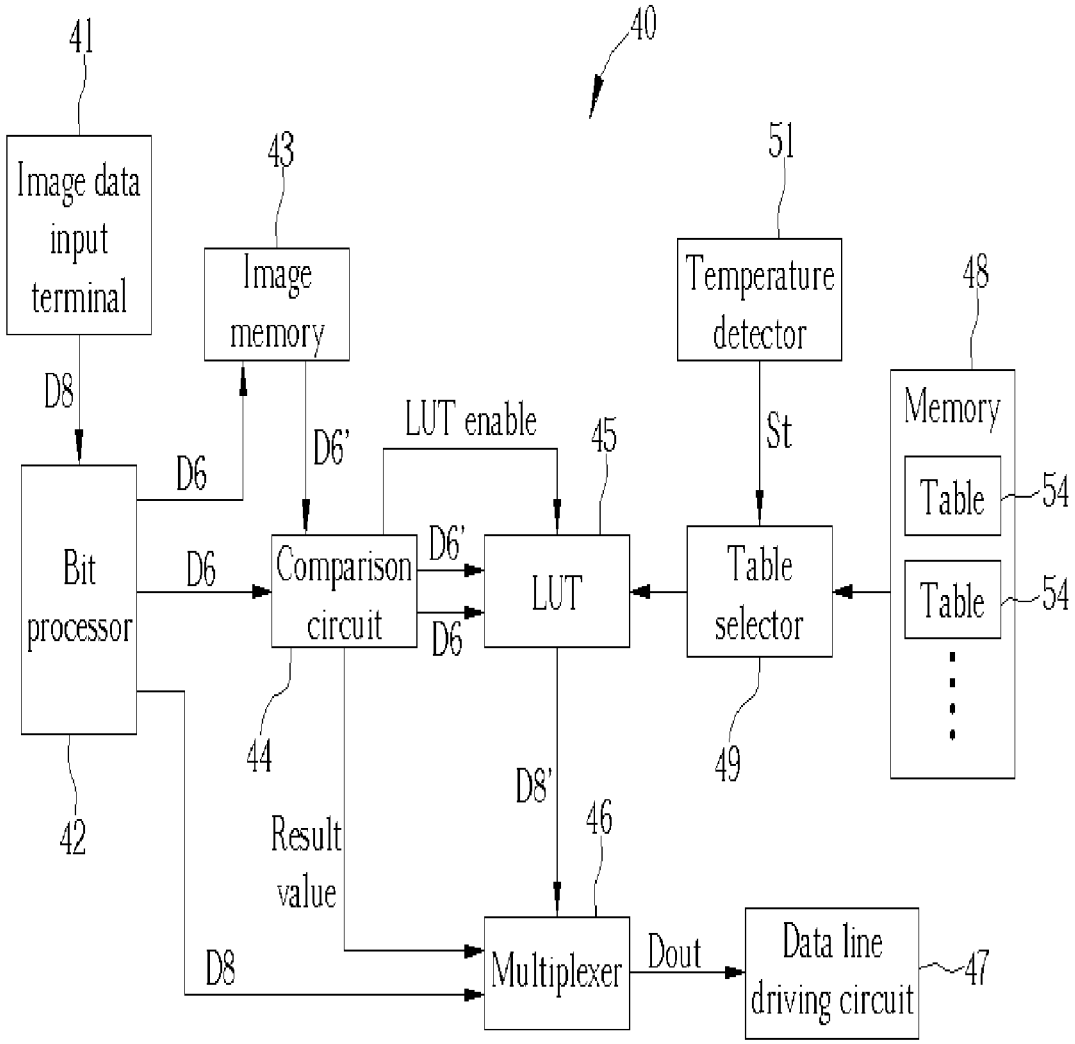
FIG. 4 is a block diagram of one embodiment of the present invention.

Please refer to FIG. 4, which is a block diagram of the first embodiment. A driving circuit 40 is utilized for driving the LCD 30 in FIG. 3. The driving circuit 40 comprises an image data input terminal 41, a bit processor 42, an image memory 43, a comparison circuit 44, a lookup table (LUT) 45, a multiplexer 46, a data line driving circuit 47, a memory 48, a table selector 49, and a temperature detector 51. In this embodiment, the image memory 43 is a 16-bit (5,6,5 or 5,5,5) memory having the necessary circuitry to read/write the memory cells. The image data input terminal 41 transfers 3 image data (RGB) to the bit processor 42, and each image data is 8 bits for controlling the gray levels of the pixel 30. Each color has 256 ($2^8$) gray levels, so the 3 image data need 24 bits (8×3) to determine a RGB image. For using the 16-bit image memory 43 in this embodiment, the bit processor 42 is used to extract most significant bits (MSB) of the 3 RGB image data. For example, extracting 5 MSB of the R image data, 6 MSB of the G image data, and 5 MSB of the B image data, and storing the extracted data in the image memory 43. It is of course possible that 5 or other quantities MSB can be extracted from 3 RGB image data as long as the total extracted bits are not more than 16.

In this embodiment, one of the 3 RGB image data is representative to explain the present invention. The image data input terminal 41 transfers an 8-bit image data D8 to the bit processor 42. The bit processor 42 processes the 8-bit image data D8 and outputs a 6-bit second extracted image data D6 and a current 8-bit image data D8. The second extracted image data D6 is the 6 MSB extracted from the current 8-bit image data D8 by the bit processor 42, and the second extracted image data D6 is stored in the image memory 43 to delay a frame period. After delayed a frame period, the second extracted image data D6 is outputted as a first extracted image data D6. In FIG. 4, the first extracted image data D6 and the second extracted image data D6 received by the comparison circuit 44 belong to different frame cycles as they differ one frame period.

The bit processor 42 transfers the second extracted image data D6 to the comparison circuit 44 and transfers the current 8-bit image data D8 to the multiplexer 46. The image memory 43 transfers the first extracted image data D6 to the comparison circuit 44. The first extracted image data D6 and the second extracted image data D6 are compared in the comparison circuit 44. A result value of 0 or 1 is determined after comparing the first extracted image data D6 and the second extracted image data D6. The result value 0 means that the first extracted image data D6 and the second extracted image data D6 are the same, and the result value 1 means that they are different. Since the first extracted image data D6 and the second extracted image data D6 are extracted from two different 8-bit image data D8, the result value 0 means that the differences between these two 8-bit image data D8 is less than 4.

For example, if the values of the first extracted image data D6 and the second extracted image data D6 are both 2 (000010), the result value of the comparison circuit 44 is 0, and the two corresponding 8-bit image data D8 are 8~11 (00001000~00001011). When the result value is 0, the pixel 36 does not need the over-driving control. On the other hand, if the result value is 1, the difference between these two 8-bit image data D8 is at least 4 and the pixel 36 needs the over-driving control. For example, if the value of the first extracted image data D6 is 2 (000010) and the value of the second extracted image data D6 is 5 (000101), the two corresponding 8-bit image data D8 are 8~11 (00001000~00001011) and 20~23 (00010100~00010111). In this situation, the pixel 36 needs the over-driving control.

Figure 5:
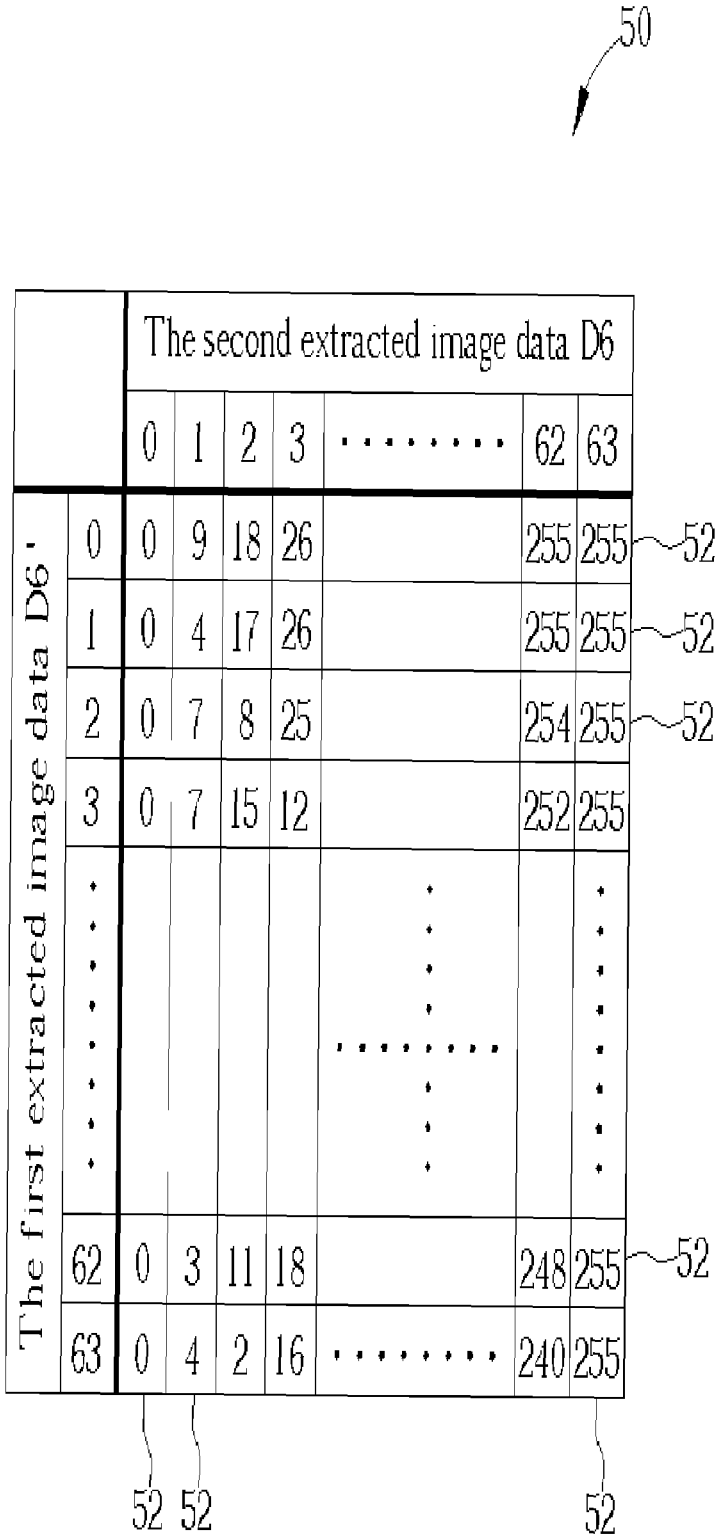
FIG. 5 is a reference table used for the lookup table in FIG. 4.

The lookup table 45 comprises a reference table, and the lookup table 45 is operated in accordance with the reference table. Please refer to FIG. 5, which illustrates a reference table 50 of the lookup table 45 in FIG. 4. The reference table 50 is recorded with ($2^6$×$2^6$) or ($2^5$×$2^5$) 8-bit image data values 52, and each image data value 52 corresponds to different first extracted image data D6 and second extracted image data D6. When the result value is 1, meaning the first extracted image data D6 and the second extracted image data D6 are different, the first extracted image data D6 and the second extracted image data D6 are transferred to the lookup table 45. Then the lookup table 45 selects a corresponding 8-bit image data value 52 from the reference table 50 as a first image value D8 according to the first extracted image data D6 and the second extracted image data D6, and transfers the first image value D8 to the multiplexer 46.

For example, when the value of the first extracted image data D6 is 2 (000010) and the value of the second extracted image data D6 is 3 (000011), the lookup table 45 selects 25 (00011001) from the reference table 50 as the first image value D8, and transfers the first image value D8 to the multiplexer 46.

In addition, the result value of the comparison circuit 44 is transferred to the multiplexer 46 to control the operation of the multiplexer 46. If the result value is 0, the multiplexer 46 will output the current 8-bit image data D8. If the result value is 1, the multiplexer 46 will output the over-driving image data D8. The output Dout of the multiplexer 46 is transferred to the data line driving circuit 47, and the data line driving circuit 47 produces a corresponding data voltage in accordance with the output Dout (D8 or D8) of the multiplexer 46. The data voltage is applied to the corresponding data line 34 to control the pixel 36.

For example, if the values of the first extracted image data D6 and the second extracted image data D6 are both 2 (000010) and the value of the current 8-bit image data D8 is 10 (00001010), the output Dout of the multiplexer 46 will be 10 (00001010) and the data line driving circuit 47 will produce a first data voltage corresponding to the output Dout. If the value of the first extracted image data D6 is 2 (000010) and the value of the second extracted image data D6 is 63 (111111), the over-driving image data D8 outputted by the lookup table 45 will be 255 (11111111), the output Dout will be 255, and the data line driving circuit 47 will produce a second data voltage corresponding to the output Dout.

Figure 6:
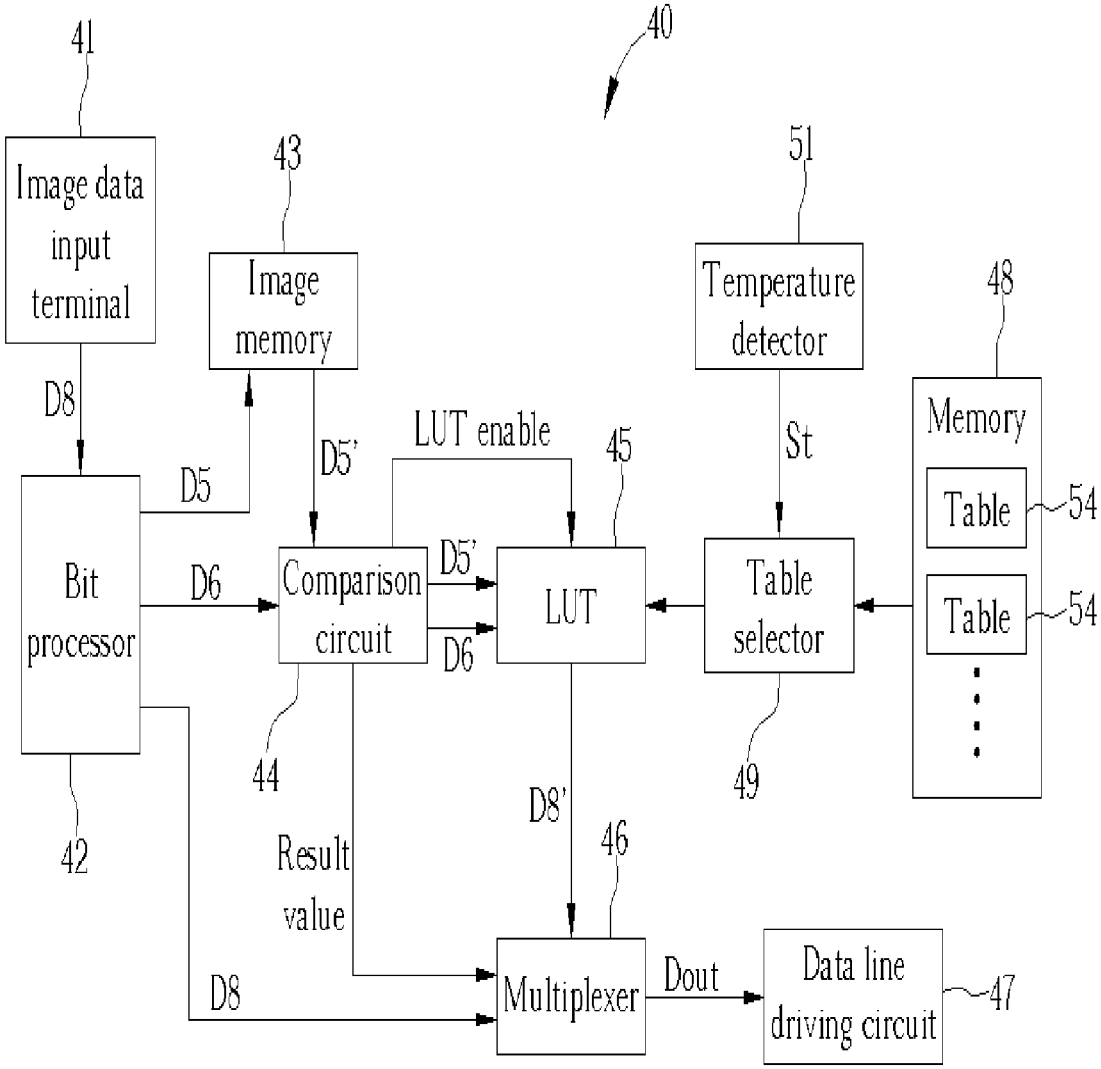
FIG. 6 is a block diagram of another application of the present invention.

FIG. 6 shows a similar embodiment of the present invention. In this situation, the bit processor 42 extracts different MSBs of the 8-bit image data D8. For example, 5 and 6 MSBs of the 8-bit image data D8 are extracted to be the first extracted image data D5 and the second extracted image data D6 respectively. As with the previous embodiment, the comparison circuit 44 compares the first extracted image data D5 and the second extracted image data D6 and determines the result value. When comparing the first extracted image data D5 and the second extracted image data D6, the comparison circuit fills the least significant bits (LSB) of the first extracted image data D5 with 0 and compares the filled first extracted image data D5 with the second extracted image data D6. For example, if the first extracted image data D5 is 7 (00111) and the second extracted image data D6 is 10 (001010), the LSB of the first extracted image data D5 is filled with 0 so that the filled first extracted image data D5 becomes 14 (001110). Then, 14 (001110) is compared with 10 (001010). Again, if the result value is 0, the pixel 36 does not need the over-driving control. If the result value is 1, the pixel 36 needs the over-driving control.

In addition, when comparing the first extracted image data D5 and the second extracted image data D6, the comparison circuit 44 can delete the LSB of the second extracted image data D6 and compare the first extracted image data D5 with the modified second extracted image data D6. For example, if the first extracted image data D5 is 7 (00111) and the second extracted image data D6 is 10 (001010), the LSB of the second extracted image data D6 is deleted, and the modified second extracted image data D6 is 5 (00101). Then, 7 (00111) is compared with 5 (00101). Similarly, if the result value is 0, the pixel 36 does not need the over-driving control. If the result value is 1, the pixel 36 needs the over-driving control.

Figure 7:
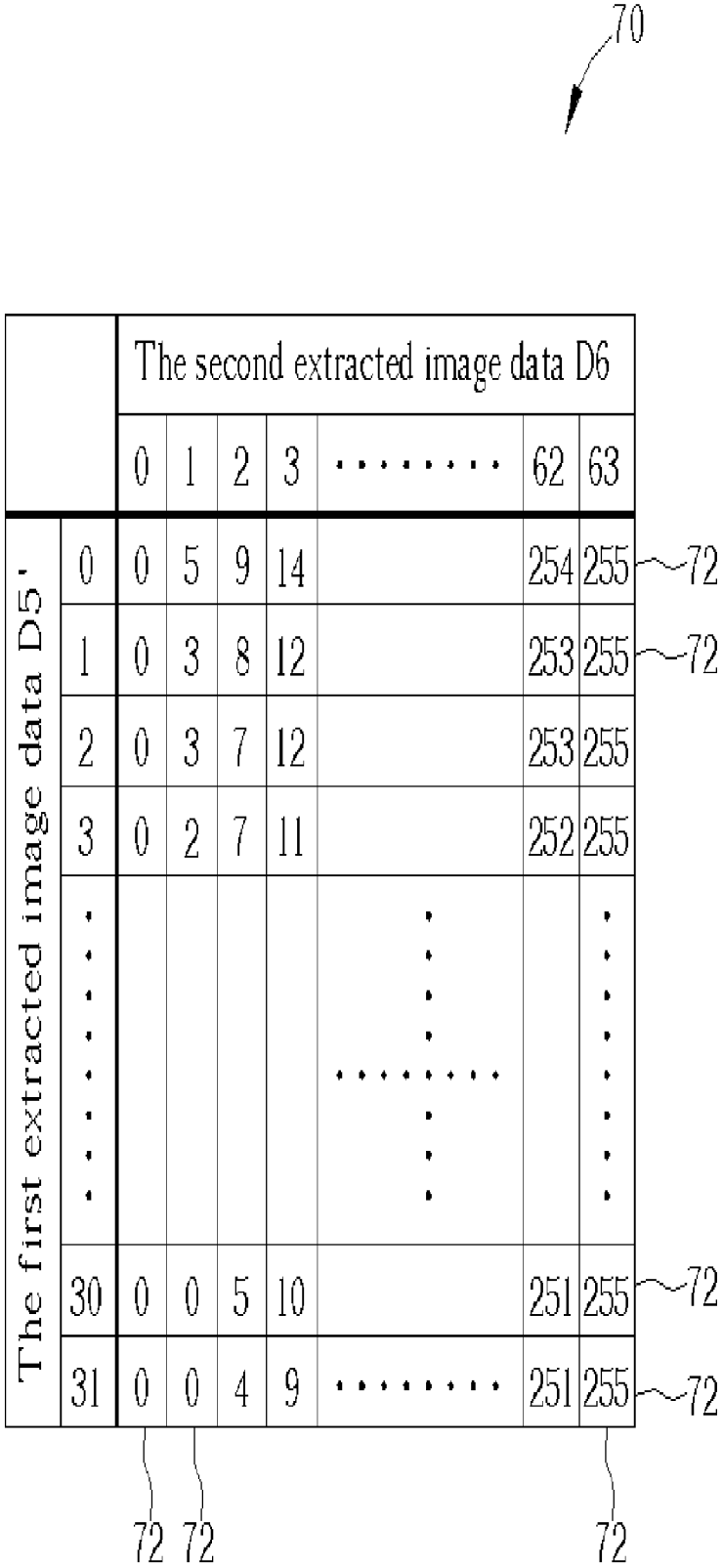
FIG. 7 is a reference table used for the lookup table in FIG. 6.

In this embodiment, the reference table used in the lookup table 45 is different. Please refer to FIG. 7, which is a reference table 70 used for the lookup table 45 in this situation. The reference table 70 is recorded with ($2^5 \times 2^6$) 8-bit image data values 72. When the result value is 1, meaning that the first extracted image data D5 and the second extracted image data D6 are different, the first extracted image data D5 and the second extracted image data D6 are transferred to the lookup table 45. Then the lookup table 45 selects a corresponding 8-bit image data value 72 from the reference table 70 as a first image value D8 according to the first extracted image data D5 and the second extracted image data D6, and transfers the first image value D8 to the multiplexer 46.

For saving power, the comparison circuit 44 can further output a LUT enable signal to the lookup table 45. When the result value is 1, the LUT enable signal will turn on the lookup table 45. When the result value is 0, the LUT enable signal will turn off the lookup table 45.

Figure 8:
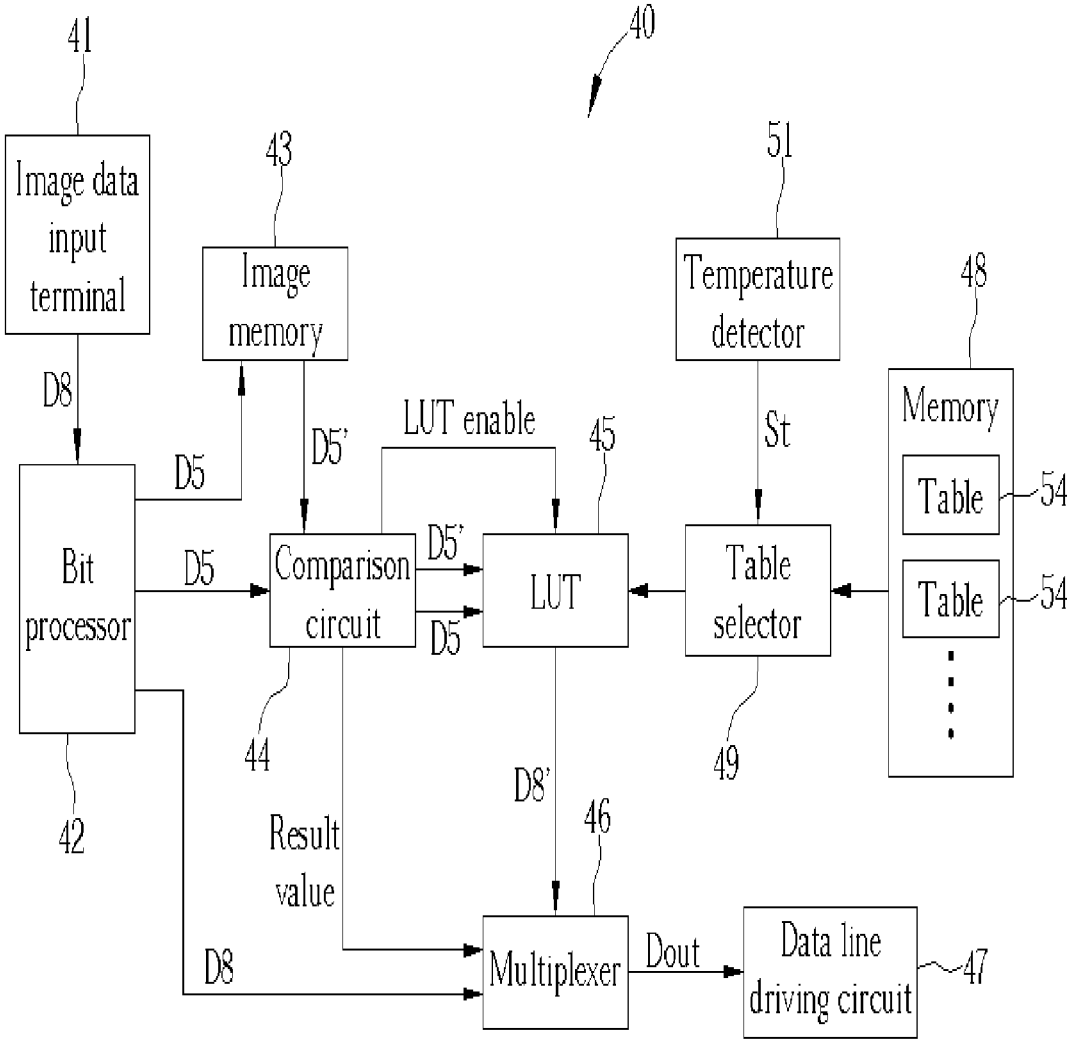
FIG. 8 is a block diagram of another application of the present invention.
Figure 9:
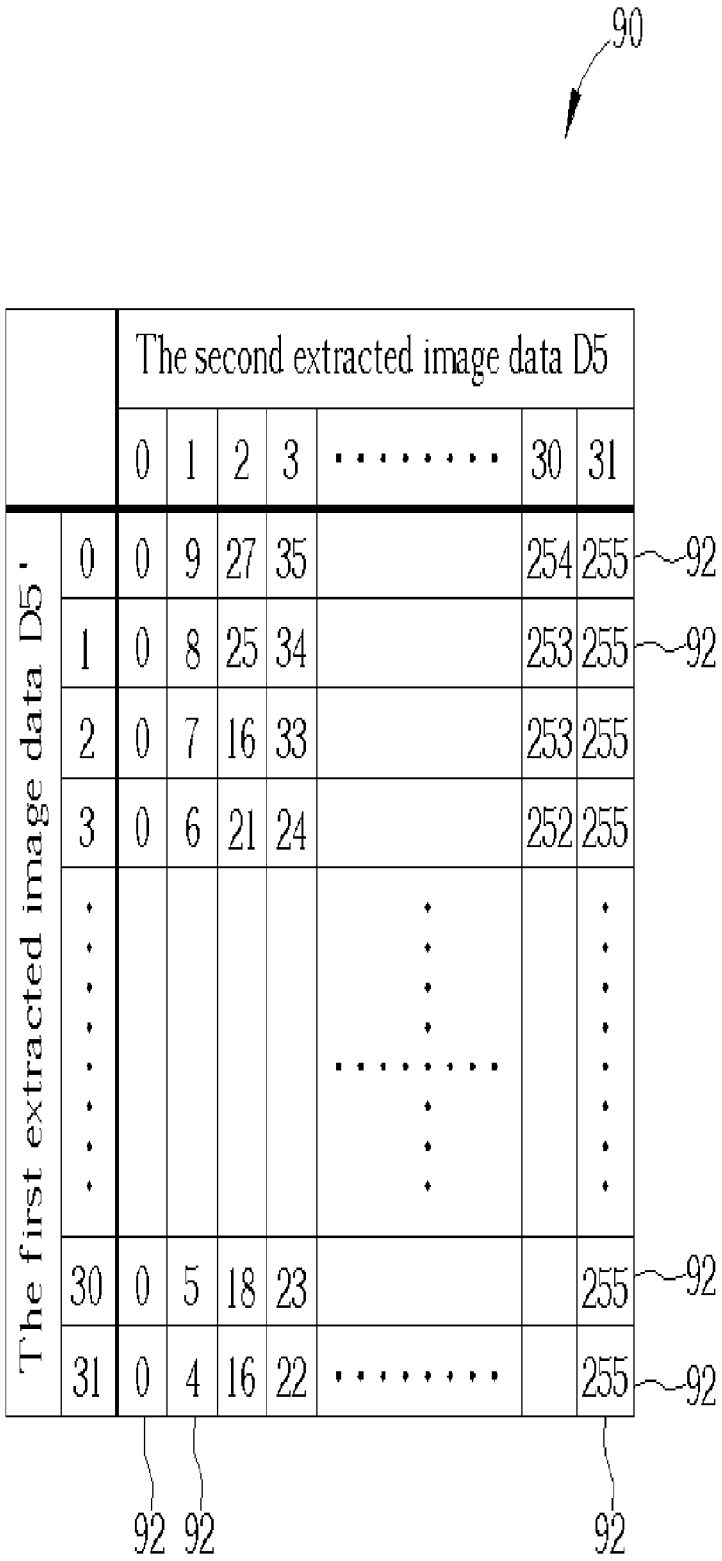
FIG. 9 is a reference table used for the lookup table in FIG. 8.

In this embodiment, the bit processor 42 extracts N and P MSBs of the 8-bit image data D8 to form the first extracted image data and the second extracted image data. As described above, the combination of (N,P) is (6,6) or (5,6), and can be other suitable values such as (5,5). Please refer to FIG. 8 and FIG. 9. FIG. 8 is a block diagram of an embodiment where (N,P) is (5,5), and FIG. 9 is a reference table 90 used for the lookup table 45 in FIG. 8. The operation where (N,P) is (5,5) is similar to that where (N,P) is (6,6), and the only difference is whether 5 or 6 MSBs of the 8-bit image data D8 is extracted. When (N,P) is (5,5), the first extracted image data D5 and the second extracted image data D5 are both 5-bit image data, and the reference table 90 is stored with ($2^5 \times 2^5$) 8-bit image data 92. The lookup table 45 selects a corresponding 8-bit image data value 92 from the reference table 90 according to the first extracted image data D5 and the second extracted image data D5 to control the followed operation of the data line driving circuit 47.

Figure 10:
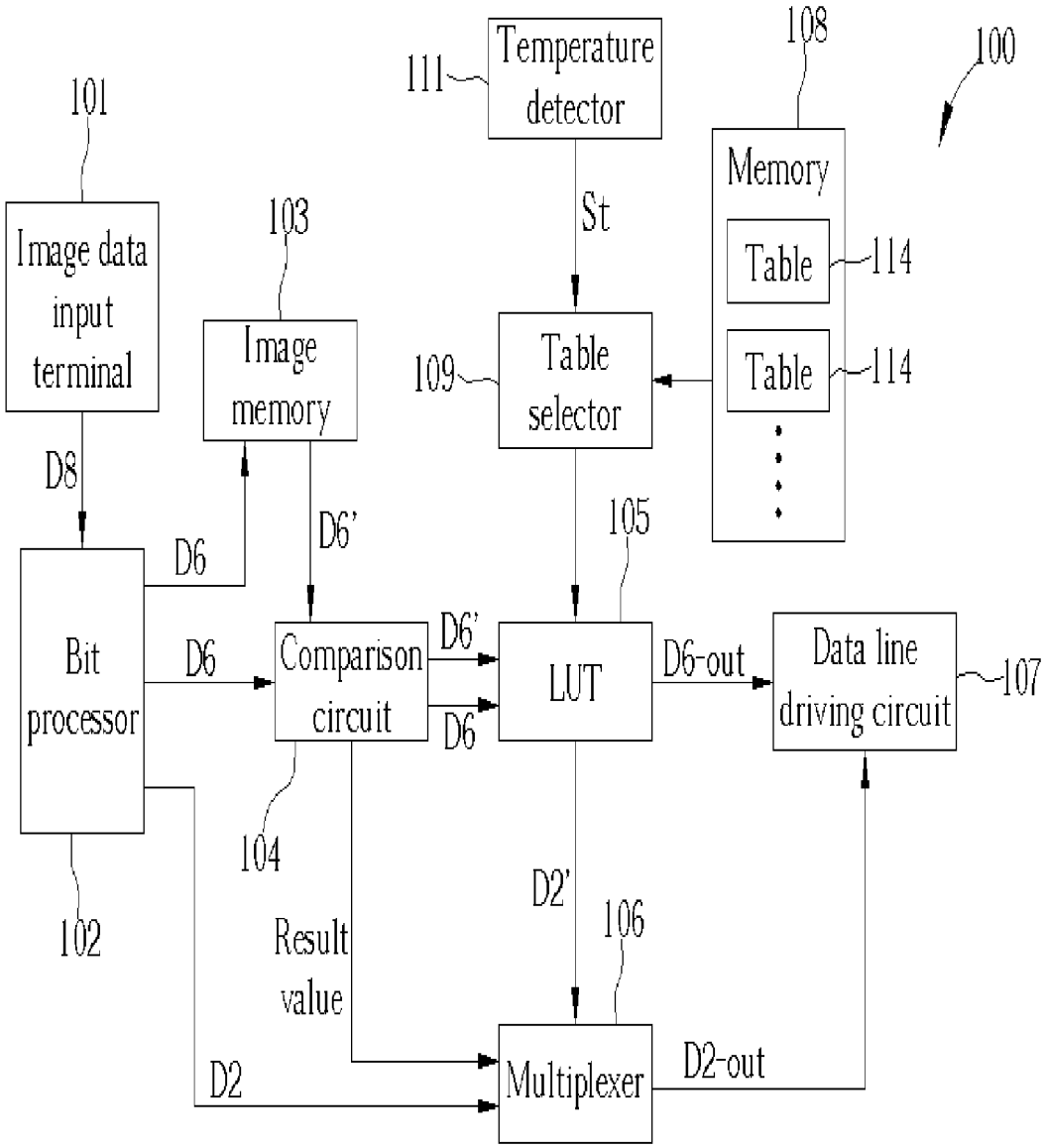
FIG. 10 is a block diagram of another embodiment of the present invention.

FIG. 10 is a block diagram of another embodiment of the present invention. The driving circuit 100 is also used for driving the LCD 30 in FIG. 3. The driving circuit 100 also comprises an image data input terminal 101, a bit processor 102, an image memory 103, a comparison circuit 104, a lookup table (LUT) 105, a multiplexer 106, a data line driving circuit 107, a memory 108, a table selector 109, and a temperature detector 111. Functions of all elements (except where stated otherwise) are the same as those of the corresponding elements in the driving circuit 40. In this embodiment, the image memory 103 is also a 16-bit memory. The image data input terminal 101 transfers 3 image data (RGB) to the bit processor 102, and each image data is 8 bits.

In this embodiment, one of the 3 RGB image data is also representative to explain the present invention. The image data input terminal 101 transfers an 8-bit image data D8 to the bit processor 102. The bit processor 102 processes the 8-bit image data D8 and outputs a 6-bit second extracted image data D6 and a 2-bit third extracted image data D2. The second extracted image data D6 is delayed a frame period and is outputted as a first extracted image data D6. The producing and transferring methods of the first extracted image data D6 and the second extracted image data D6 are the same as those in the previous embodiments. The bit processor 102 extracts 2 LSB of the 8-bit image data D8 to form the third extracted image data D2, and the third extracted image data D2 is transferred to the multiplexer 106.

The first extracted image data D6 and the second extracted image data D6 are also compared in the comparison circuit 104, and a result value 0 or 1 is determined. In this embodiment, the comparison process and the definition of the result value are all same as those in the previous embodiments. The comparison circuit 104 transfers the first extracted image data D6 and the second extracted image data D6 to the lookup table 105, and transfers the result value to the multiplexer 106. Similarly to the previous embodiments, the bit numbers of the first extracted image data D6 and the second extracted image data D6 are the same or different. When D6 and D6 are different, the lookup table 105 selects the over-driving image data from the reference table 50, 70, or 90.

When the lookup table 105 is operated, the lookup table 105 selects a 8-bit over-driving image data from the reference table 50, 70, or 90 according to the first extracted image data D6 and the second extracted image data D6, and extracts 2 LSB D2 and 6 MSB D6-out of the 8-bit over-driving image data. Consider an example, when the value of the first extracted image data D6 is 2 (000010) and the value of the second extracted image data D6 is 3 (000011). The lookup table 105 selects 25 (00011001) from the reference table 50 (FIG. 5) as the 8-bit over-driving image value, and extracts 2 LSB (01) and 6 MSB (000110) of the 8-bit over-driving image value (00011001)to separately transfer to the multiplexer 106 and the data line driving circuit 107 as D2 and D6-out. Similarly, the result value is transferred to the multiplexer 106 to control its operation. If the result value is 0, the multiplexer 106 will output the 2 LSB D2 of the current 8-bit image data D8. If the result value is 1, the multiplexer 106 will output D2 of the lookup table 105. The output D2-out of the multiplexer 106 is transferred to the data line driving circuit 107, and the data line driving circuit 107 produces a corresponding data voltage in accordance with the output D2-out (D2 or D2) of the multiplexer 106 and the output D6-out of the lookup table 105. The data voltage is applied to a corresponding data line 34 to control the pixel 36.

For example, if the first extracted image data D6 and the second extracted image data D6 are both 2 (000010) and the current 8-bit image data D8 is 11 (00001011), the lookup table 105 will select the over-driving image data 52 which has a value of 8 (00001000) from the reference table 50. The output D2 is 0 (00) and the output D6-out is 2 (000010), and the output D2-out of the multiplexer 106 equals the third extracted image data D2 (11). The data line driving circuit 107 produces a corresponding first data voltage in accordance with the 2 LSB D2 of the current 8-bit image data D8 and the 6 MSB D6-out of the over-driving image data 52 which has the value of 8 (00001000). If the first extracted image data D6 is 2 (000010) and the second extracted image data D6 is 63 (111111), the lookup table 105 will select the over-driving image data 52 whose value is 255 (11111111) from the reference table 50. The output D2 is 3 (11) and the output D6-out is 63 (111111), and the data line driving circuit 107 produces a corresponding second data voltage in accordance with the over-driving image data 52 which value is 255.

When the liquid crystal molecules of the LCD 30 are twisted, the response time differs with the temperature of the liquid crystal panel 31. For the best performance of the LCD 30, the driving circuits 40 and 100 select a suit-able reference table according to the temperature of the liquid crystal panel 31. As FIG. 4 and FIG. 10 show, the memory 48 and 108 comprise a plurality of tables 54 and 114, and each table 54 or 114 corresponds to different temperatures of the liquid crystal panel 31. When the driving circuit 40 or 100 is operated, the temperature detector 51, 111 will detect the temperature of the liquid crystal panel 31 and produce a temperature compensation signal St. The temperature compensation signal St is transferred to a table selector 49, 109 to determine a suitable reference table, and the selected reference table is transferred to the lookup table 45, 105 for outputting the image data D8 or D2.

In the above embodiments, the circuit devices, the extracting method, the delaying method, the comparison method and the reference tables are all similar. The difference is that the 8-bit values in the reference tables are directly outputted to the multiplexer in the first embodiments, and the 8-bit values of the reference tables are divided into 2 LSB and 6 MSB and are separately outputted to the multiplexer and the data line driving circuit in the embodiment shown in FIG. 10. Furthermore, the LSB and MSB in the present invention are not limited in 6-bit, 5-bit, or 2-bit, and can be other values.

In contrast to the prior art, the reference tables in the present invention are built by actually measuring the over-driving voltages needed for properly driving the liquid crystal panel in a frame period. The reference tables include all of the over-driving image data that drives the pixels from any gray level to another, so the processor used to expand the brief table is not needed, and the efficiency can be improved. Additionally, the driving circuit and the driving method of the present invention extract LSB or MSB of a general bit length, so the management of the image memory can be more convenient and efficient.

Those skilled in the art will readily observe that numerous modifications and alterations of the device may be made while retaining the teachings of the invention. Accordingly, the above disclosure should be construed as limited only by the metes and bounds of the appended claims.

The invention claimed is:

1. A driving circuit for driving a liquid crystal display, the liquid crystal display comprising:

a liquid crystal panel, the liquid crystal panel comprising:

a plurality of scan lines;

a plurality of data lines; and a plurality of pixels, each pixel is connected to a corresponding scan line and a corresponding data line, and each pixel has a switching device connected to the corresponding scan line and the corresponding data line;

the driving circuit comprising:

a scan line driving circuit for continuously providing scan voltages to the scan lines;

an image data input terminal for receiving an M-bit image data;

a bit processor for extracting N most significant bits (MSB) from the M-bit image data to form an N-bit image data, N is smaller than M;

an image memory for storing the N-bit image data and delaying the N-bit image data by a frame period;

a comparison circuit for comparing P MSB of a current M-bit image data with the N-bit delayed image data to determine a result value;

a lookup table (LUT) for outputting an M-bit over-driving image value in accordance with the P MSB and the N-bit delayed image data;

a multiplexer for outputting the M-bit over-driving image value when the result value indicates that the P MSB of the current M-bit image data and the N-bit delayed image data are not equal, and for outputting the M-bit image data when the result value indicates that the P MSB of the current M-bit image data and the N-bit delayed image data are equal; and a data line driving circuit for forming a data voltage in accordance with output of the multiplexer, and providing the data voltage to the corresponding data line.

2. The driving circuit of claim 1 further comprising:

a temperature detector for detecting temperature of the liquid crystal panel, and producing a temperature compensation signal in accordance with temperature of the liquid crystal panel;

a memory for storing a plurality of tables; and a selector for selecting a reference table from the plurality of tables stored in the memory in accordance with the temperature compensation signal, and transferring the selected reference table to the LUT to make the LUT output the M-bit over-driving image value in accordance with the selected reference table.

3. The driving circuit of claim 2 wherein the reference table is recorded with ($2^N \times 2^P$) image data values.

4. The driving circuit of claim 1 wherein P is greater than N.

5. The driving circuit of claim 1 wherein P equals N.

6. A driving circuit for driving a liquid crystal display, the liquid crystal display comprising:

a liquid crystal panel, the liquid crystal panel comprising:

a plurality of scan lines;

a plurality of data lines; and a plurality of pixels, each pixel is connected to a corresponding scan line and a corresponding data line, and each pixel has a switching device connected to the corresponding scan line and the corresponding data line;

the driving circuit comprises:

a scan line driving circuit for continuously providing scan voltages to the scan lines;

a image data input terminal for receiving an M-bit image data;

a bit processor for extracting N most significant bits (MSB) from the M-bit image data to form an N-bit image data, N is smaller than M;

an image memory for storing the N-bit image data and delaying the N-bit image data by a frame period;

a comparison circuit for comparing P MSB of a current M-bit image data with the N-bit delayed image data to determine a result value;

a lookup table (LUT) for outputting an over-driving image value in accordance with the P MSB and the N-bit delayed image data;

a multiplexer for outputting Q least significant bits (LSB) of the over-driving image value when the result value indicates that the P MSB of the current M-bit image data and the N-bit delayed image data are not equal, and for outputting Q LSB of the M-bit image data when the result value indicates that the P MSB of the current M-bit image data and the N-bit delayed image data are equal; and a data line driving circuit for producing a data voltage in accordance with output of the multiplexer and (M-Q) MSB of the over-driving image value, and providing the data voltage to the corresponding data line.

7. The driving circuit of claim 6 further comprising:

a temperature detector for detecting temperature of the liquid crystal panel, and producing a temperature compensation signal in accordance with temperature of the liquid crystal panel;

a memory for storing a plurality of tables; and a selector for selecting a reference table from the plurality of tables stored in the memory in accordance with the temperature compensation signal, and transferring the selected reference table to the LUT to make the LUT output the over-driving image value in accordance with the selected reference table.

8. The driving circuit of claim 7 wherein the reference table is recorded with ($2^N \times 2^P$) image data values.

9. The driving circuit of claim 6 wherein P is greater than N.

10. The driving circuit of claim 6 wherein P equals N.

* * * * *